US006065500A

United States Patent [19]

Metcalfe

[11] Patent Number: 6,065,500

[45] Date of Patent: May 23, 2000

[54] EXPANDABLE TUBING

[75] Inventor: Paul David Metcalfe, Peterculter, United Kingdom

[73] Assignee: Petroline Wellsystems Limited, Aberdeen, United Kingdom

[21] Appl. No.: 09/319,558

[22] PCT Filed: Dec. 12, 1997

[86] PCT No.: PCT/GB97/03450

§ 371 Date: Jun. 8, 1999

§ 102(e) Date: Jun. 8, 1999

[87] PCT Pub. No.: WO98/26152

PCT Pub. Date: Jun. 18, 1998

[30] Foreign Application Priority Data

Dec. 13, 1996 [GB] United Kingdom ..... 9625939

[51] Int. Cl.[7] ..... F16L 11/00; F16L 9/00

[52] U.S. Cl. ..... 138/118; 138/177; 138/178

[58] Field of Search ..... 138/156, 170, 138/128, 169, 118, 177, 178

[56] References Cited

U.S. PATENT DOCUMENTS

| | | | |
|---|---|---|---|
| 1,026,598 | 5/1912 | Neff | 138/118 |
| 1,087,443 | 2/1914 | Hallgreen | 138/118 |
| 2,633,374 | 3/1953 | Boice . | |
| 4,349,050 | 9/1982 | Bergstrom et al. . | |

FOREIGN PATENT DOCUMENTS

96/01250 11/1996 WIPO .

*Primary Examiner*—Patrick Brinson
*Assistant Examiner*—Davis Hwu
*Attorney, Agent, or Firm*—Alston & Bird LLP

[57] ABSTRACT

Expandable tubing, as utilized in downhole applications in the oil and gas exploration and extraction industries, includes tubing having a wall with a multiplicity of overlapping longitudinally extending slots therein. The slots have end portions and at least some of the slots are wider at at least one end portion.

9 Claims, 2 Drawing Sheets

EXPANDABLE TUBING

This invention relates to expandable tubing comprising tubing have a multiplicity of overlapping longitudinally extending slots therein. In particular, but not exclusively, the invention relates to expandable tubing as utilised in downhole applications in the oil and gas exploration and extraction industries, such as the tubing sold under the EST trademark by the applicants.

WO93/25800 (Shell Internationale Research) discloses a tubing comprising lengths of tube which have been machined to create a large number of overlapping longitudinal slots. The tube may be expanded radially outwardly by running a mandrel through the tubing. The magnitude of the force necessary to expand the tubing is related to the number of slots in the tubing, that is the fewer the number of slots the greater the expanding force. Further, expandable tubing provided with relatively few slots is more prone to fracture and catastrophic failure of the tubing during expansion. However, forming a large number of slots in a section of tubing weakens the tubing and renders the tubing more susceptible to damage during handling and running into the borehole.

It is among the objectives of embodiments of the present invention to obviate or mitigate these difficulties.

According to the present invention there is provided expandable tubing comprising tubing having a multiplicity of overlapping longitudinally extending slots therein, at least some of the slots being wider at one or both slot end portions.

Surprisingly, it has been found that increasing the width of the slot ends, without increasing the width of the remainder of the slot, reduces the force required to expand the tubing without reducing the strength of the tubing to any significant degree. Without wishing to be bound by theory, it is believed that the force necessary to expand a section of tubing is a function of the width of the "finger" between adjacent overlapping slots; by enlarging the slot ends, the effective width of the finger is reduced to the circumferential spacing between the adjacent enlarged slot ends.

Preferably, each slot is wider at both ends.

Preferably also, a majority of the slots in the tubing are wider at one or both end portions.

Preferably also, the wider slot end portions are symmetrical about the respective longitudinal slot axis. Conveniently, the slot end portions are widened by provision of transverse slots at the slot ends, although other slot or recess forms, such as round holes, at or adjacent the slot ends, may be utilised. Such widening of the slot ends provides slots with a "dog bone" appearance.

As used herein, the term slot is intended to encompass any cutting, machining or weakening of the tubing intended to facilitate radial expansion, including slots which extend only partially through the tubing and which permit the remaining thinned sections to fracture or extend.

This and other aspects of the present invention will now be described, by way of example, with reference to the accompanying drawings, in which.

Figure 1:
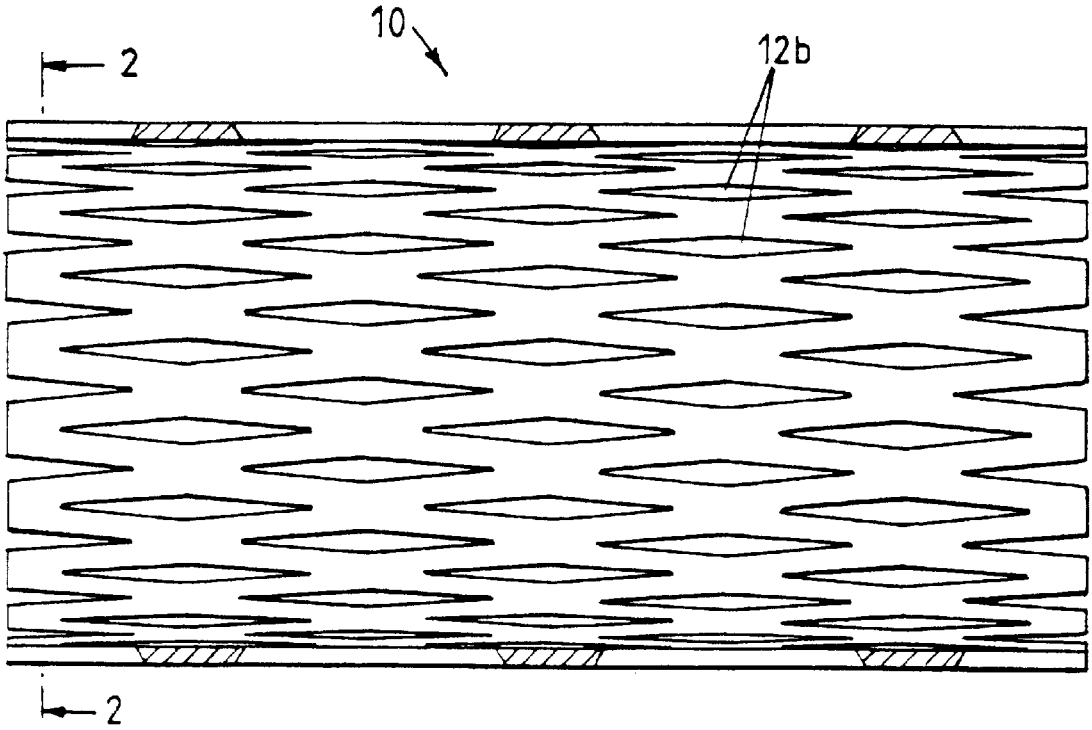
FIG. 1 (PRIOR ART)
FIG. 1 is a sectional view of a length of prior art expandable tubing, shown in an expanded configuration.
Figure 2:
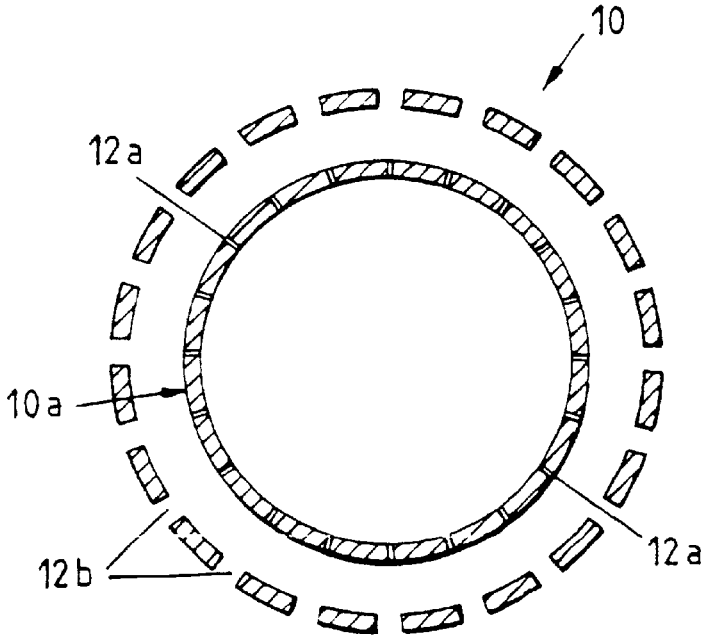
FIG. 2 (PRIOR ART)
FIG. 2 is a sectional view on line 2—2 of FIG. 1 and also shows the prior art tubing in unexpanded configuration.

Reference is first made to FIGS. 1 and 2 of the drawings, which illustrate a length of conventional expandable slotted tubing 10. In its initially unexpanded configuration, the tubing 10 is simply a length of pipe in which a series of longitudinal slots 12 have been machined (shown as tube 10*a* with slots 12*a* in FIG. 2). Applying radially outward force to the tubing wall, for example by passing a mandrel through the tubing, causes the tube to expand such that the slots 12*a* become diamond-shaped openings 12*b*, as described in WO93/25800.

Figure 3:
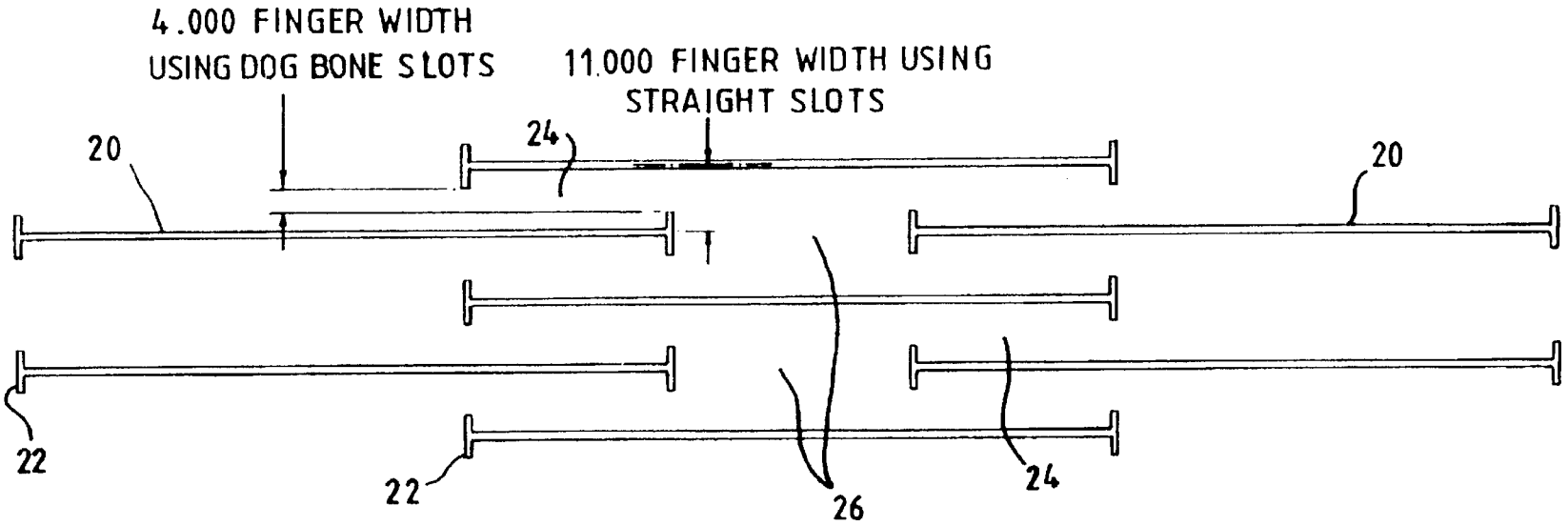
FIG. 3 is a view of a portion of the wall of expandable tubing in accordance with a preferred embodiment of the present invention.

Reference is now made to FIG. 3 of the drawings, which illustrates a section of tubing wall in accordance with a preferred embodiment of the present invention. The tubing wall defines a series of longitudinal slots 20, each having shorter transverse slots 22 at the ends thereof. In this particular example the slots 20 are 115 mm long, whereas the transverse slots 22 are 8 mm long. The area of tubing between adjacent overlapping slots is known as a finger 24, whereas the areas between the ends of aligned slots 20, which areas are generally subject to negligible deformation during expansion, are known as nodes 26.

Testing has revealed that the magnitude of force necessary to expand a section of tubing is related to the width of the fingers 24 between the overlapping slot ends. In the example illustrated in FIG. 3, if the transverse slots 22 were not provided, the finger width between the slots 20 would be 11 mm. However, the provision of the transverse slots 22 reduces the effective width of the fingers 24 to only 4 mm, substantially reducing the magnitude of force which is necessary to expand the tubing. Surprisingly, it has been found that providing such transverse slots does not result in a significant decrease in the strength of the slotted tubing.

It will be clear to those of skill in the art that the above-described embodiment is merely exemplary of the present invention, and that modifications and improvements may be made thereto without departing from the scope of the invention.

What is claimed is:

1. Expandable tubing comprising tubing having a wall with a multiplicity of overlapping longitudinally extending slots therein, the slots having end portions, at least some of the slots being wider at at least one end portion.

2. The tubing of claim 1, wherein said at least some of the slots are wider at both end portions.

3. The tubing of claim 1, wherein a majority of the slots in the tubing are wider at at least one end portion.

4. The tubing of claim 1, wherein the wider slot end portions are symmetrical about a respective longitudinal slot axis.

5. The tubing of claim 1 wherein the wider slot end portions include transverse slots located at ends of the longitudinally extending slots.

6. Expandable tubing comprising tubing having a wall with a multiplicity of overlapping longitudinally extending slots therein, the slots having end portions, at least some of the slots being wider at both slot end portions.

7. The tubing of claim 6, wherein a majority of the slots in the tubing are wider at both end portions.

8. The tubing of claim 6, wherein the wider slot end portions are symmetrical about a respective longitudinal slot axis.

9. The tubing of claim 6 wherein the wider slot end portions include transverse slots located at ends of the longitudinally extending slots.

* * * * *